US005867081A

United States Patent [19]

Arnoux et al.

[11] Patent Number: 5,867,081

[45] Date of Patent: Feb. 2, 1999

[54] BISTABLE ELECTROMAGNETIC RELAY ARRANGEMENT

[75] Inventors: Daniel Arnoux; Axel Arnoux; Claude Genter, all of Paris, France

[73] Assignee: Chauvin Arnoux, Paris, France

[21] Appl. No.: 974,825

[22] Filed: Nov. 20, 1997

[30] Foreign Application Priority Data

Nov. 20, 1996 [FR] France ..... 96 14157

[51] Int. Cl.[6] ..... H01H 9/00

[52] U.S. Cl. ..... 335/177; 335/78; 335/80; 335/179; 335/84; 335/132; 335/230; 335/232; 335/267

[58] Field of Search ..... 335/78–86, 230, 335/231, 232, 177–179, 266, 267, 132

[56] References Cited

U.S. PATENT DOCUMENTS

| | | | |
|---|---|---|---|
| 1,695,907 | 12/1928 | Wensley . | |
| 2,728,880 | 12/1955 | Ashworth . | |
| 2,735,968 | 2/1956 | Bogue et al. . | |
| 2,942,080 | 6/1960 | Hodgson . | |
| 3,518,589 | 6/1970 | Koehler | 335/132 |
| 3,533,033 | 10/1970 | Allen | 335/230 |
| 3,721,927 | 3/1973 | Braumann et al. | 335/179 |
| 5,587,693 | 12/1996 | Fear | 335/78 |

FOREIGN PATENT DOCUMENTS

| | | |
|---|---|---|
| 1 527 178 A | 11/1968 | France . |
| 37 05 918 A | 9/1988 | Germany . |
| 1 178 278 | 1/1970 | United Kingdom . |

*Primary Examiner*—Michael L. Gellner
*Assistant Examiner*—Tuyen T. Nguyen
*Attorney, Agent, or Firm*—Pennie & Edmonds LLP

[57] ABSTRACT

A polarized bistable electromagnetic relay arrangement comprising at least two monostable instantaneous electromagnetic relay devices with a L-shaped yoke, a permanent magnet disposed between both relay devices so that one magnetic pole be magnetically connected by polar masses to both yokes of the relay devices and polar masses magnetically connect the other pole of the magnet to both blades whereas the magnetic circuits of both relay devices are designed so that the magnetic flux produced by one energized coil passes in series through both blades while superposing themselves to the magnetic flux produced by the permanent magnet.

20 Claims, 7 Drawing Sheets

N
S
F
Fa
Fb
Fl
1
2
3
5
6
7
9a
9b
10
11
12
15
16
17
18
20
21
23
24
25
26
28
30
31
33
35
36
37
38
41
42
43

BISTABLE ELECTROMAGNETIC RELAY ARRANGEMENT

TECHNICAL FIELD

The present invention relates to an arrangement of a polarized bistable electromagnetic relay comprising at least two monostable instantaneous electromagnetic relay devices comprising each one a L-shaped yoke one flange of which carries a relay coil core, an electric contacts unit, an armature pivotally mounted between a position of contact with the free end of the core and a position spaced from the latter and one of which forms the rest position and the other one of which forms the working position for the actuation of the said electric contacts, and an energizing coil for causing the pivoting of the armature and means for interaction between the relay devices so that the energizing of a coil causes the attraction of one armature and the repelling of the other one.

BACKGROUND ART

Bistable relay arrangements of this type are already known from the French patent N° 1,527,178. In this known arrangement, the yoke, the core and the armature of each relay device form a magnetic circuit which is independent of that of the other device. The interaction means are of complex structural mechanical nature and comprise a fork fastened onto the yokes made as one single piece and onto which is pivotally connected a ring bow urged towards the coils by resilient and flexible rods hooked thereto. The ring bow is positioned to bear upon two cams mounted straddlewise onto the upper edge of two armature blades with one cam exhibiting a shape permitting an unhooking from the ring bow whereas the other one carries a tooth likely to be caused to hook itself thereonto.

It is obvious that this complex mechanical structure which interconnects both monostable relay devices in order that the arrangement may operate as a bistable relay results in considerable inconveniences such as those of a high cost price and of reduced reliability and operating speed.

SUMMARY OF THE INVENTION

The object of the present invention is to provide a bistable relay arrangement which copes with the Inconveniences of the know state of prior art.

For reaching this goal, the bistable relay arrangement according to the invention is characterized in that it comprises a permanent magnet disposed between both relay devices so that one magnetic pole be magnetically connected to both yokes of the relay devices and polar masses magnetically connect the other pole of the magnet to both blades and in that the magnetic circuits of both relay devices are designed so that the magnetic flux produced by an energized coil passes in series through both blades while superposing itself to the magnetic flux produced by the permanent magnet.

According to a characterizing feature of the invention, the L-shaped yokes one flange of which carries the core carrying an energizing coil, of both relay devices are axially aligned while leaving a predetermined gap therebetween whereas a bar made from a magnetic material extends in the plane of the two other flanges over the whole length of the aligned yokes at a predetermined spacing from the ends of the latter, preventing a passage of magnetic flux between the bar and the ends and whereas both blades are pivotally mounted onto this bar and two systems of polar masses are provided which magnetically connect both flanges, respectively, carrying the core of the yokes of the relay devices and the blades, each system of polar masses being magnetically connected to one pole of the permanent magnet.

According to another advantageous characterizing feature of the invention, the systems of polar masses rest upon a non magnetic support laid upon the flanges which do not carry the core of the relay device and the bar of magnetic material.

According to still another advantageous characterizing feature of the invention, each blade is hinged in a pivotal manner to that lower longitudinal edge line of the bar made from magnetic material which is remote from the yokes of the relay devices at the level of the lower edge of its internal face.

According to still another advantageous characterizing feature of the invention, the arrangement comprises a safety device in the shape of a swinging member provided with a lever with two arms which is pivotally mounted in a plane parallel to those flanges which do not carry any core, in the middle between them and the ends of the lever are connected to both blades, respectively, so that the motion of a blade being repelled from the core of the relay device with which it is associated results in the motion of the other blade being pulled towards its core.

BRIEF DESCRIPTION OF THE DRAWINGS

The invention will be better understood and further objects, characterizing features, details and advantages thereof will appear more clearly as the following explanatory description proceeds with reference to the attached diagrammatic drawings given by way of non limiting example only illustrating one single embodiment of the invention and in which:

FIG. 9 is a view in section taken upon the line IX—IX of FIG. 5; and

DETAILED DESCRIPTION OF THE INVENTION

Figures 1, 3, 4:
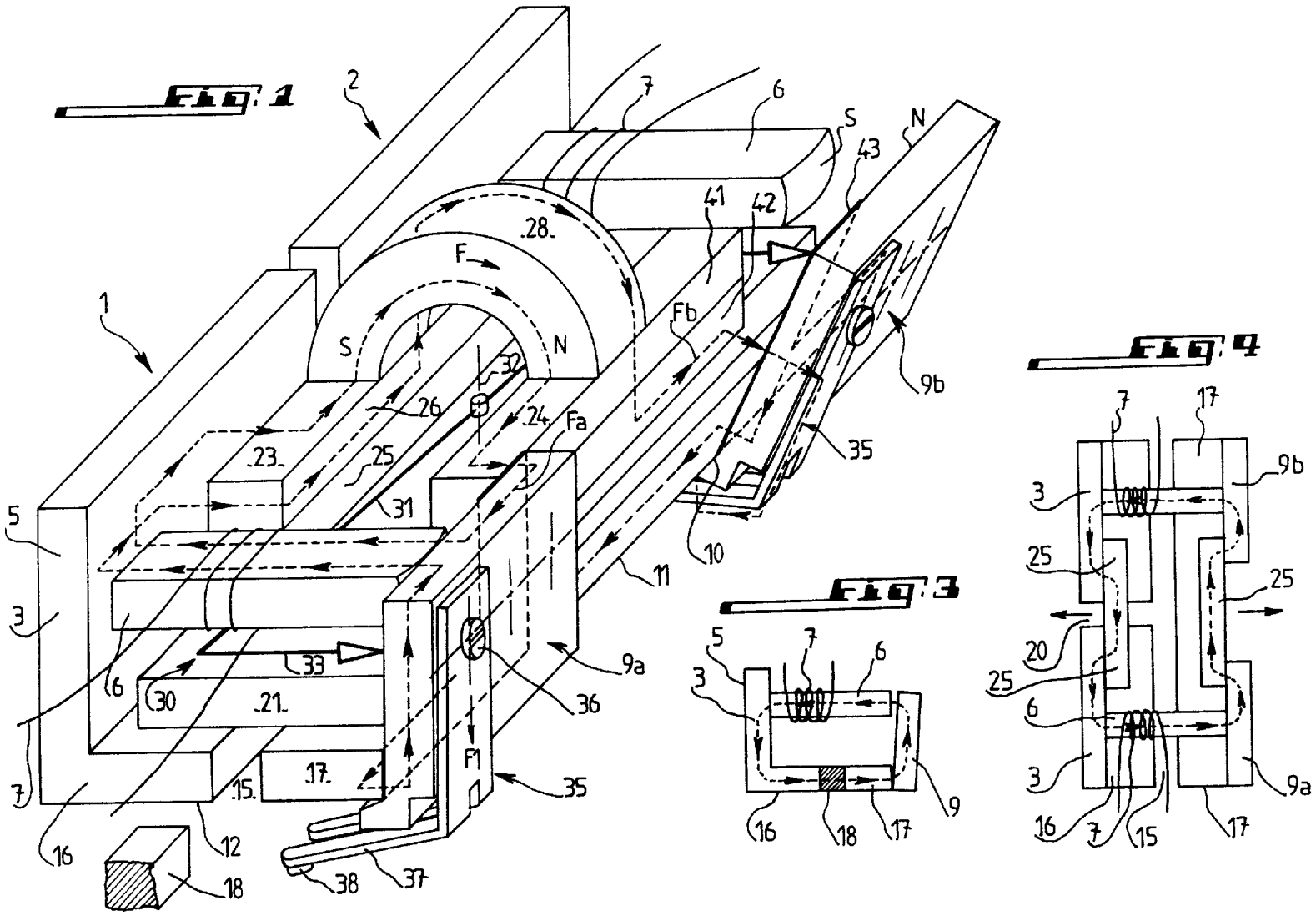
FIG. 1 is a diagrammatic simplified perspective view of a bistable relay arrangement according to the present invention for explaining the operation thereof by demonstrating the lines of magnetic flux in the absence of energizing of the relay coils.
FIGS. 3 and 4 are two diagrammatic views showing two phases of assembly of the bistable relay arrangement according to FIGS. 1 and 2.
Figure 2:
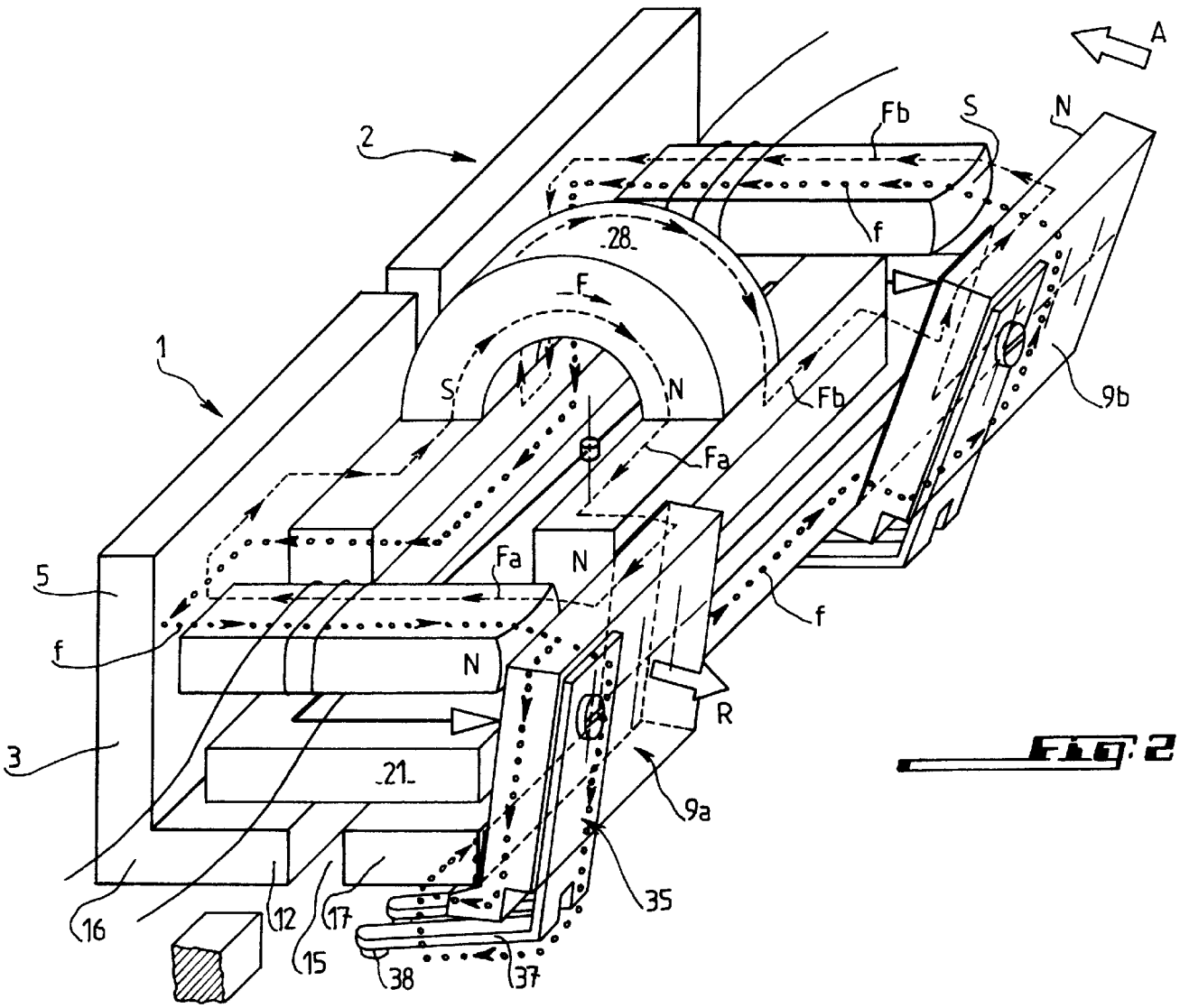
FIG. 2 is a view similar to that of FIG. 1 but showing the magnetic flux lines in the case of the energizing of one of the two coils.

Referring to the figures in particular to the simplified FIGS. 1 and 2, one sees that a polarized bistable electromagnetic relay arrangement according to the present invention comprises in the example shown two monostable instantaneous electromagnetic relay devices 1 and 2 of the type disclosed in the French patent No 1,527,178. Each relay device 1 and 2 comprises a yoke 3 in the shape of an L one flange of which denoted at 5 carries a magnetic core 6 onto which is fitted a coil 7 which is only diagrammatically shown on the FIGS. 1 and 2 but is clearly visible in particular on FIGS. 9 and 10, as well as movable armatures 9*a*, 9*b* provided as blades the lower portion of which is V-shaped. This blade is pivotally mounted at the level of the corner edge line of its internal face on the external lower longitudinal edge line 11 of the flange 12 which does not carry any coil of the relay device 3. However differing from the conventional monostable relay device according to the above-mentioned French patent, in the case of the bistable relay arrangement according to the present invention, the flange 12 of the yoke exhibits a hollow 15 which extends over the whole length of the flanges of the aligned yokes so that this flange is indeed constituted by the portions 16 which are formed by the flanges of the sectional L-shaped bars and by one portion in the shape of a bar with a rectangular cross-section 17 which is separated by the flange 16 while defining with the latter the longitudinal hollow or gap 15. As seen in particular on FIG. 3, the gap 15 of the flange 12 of the yokes may be filled by the insertion of a magnetic strip 18 for reasons which will be explained later.

As shown on the figures in the bistable relay arrangement according to the present invention, both yokes 3 are axially aligned while leaving a slot 20 therebetween.

According to the invention, a plate 21 made from a non magnetic material is laid upon the flanges 12 of the elementary relays 1 and 2 of the bar 17. Upon this plate 21 are laid two systems of polar masses 23, 24, in contact with the flanges 5, respectively, of the yokes 3 of both elementary relays and both blades 9*a*, 9*b* when the latter assume their closing position, i.e. in contact with the ends of the cores 6. Each system of polar masses 23, 24 is formed by the superposition of two bars 25, 26 and 41, 42, respectively with a rectangular cross-section. As shown in particular on FIGS. 1 and 2, the polar mass bars 25, 26 extend in parallel relation to the axis of the yokes and are disposed symmetrically with respect to the slot 20 left therebetween. The lengths of the bars 25 and 26 are selected so that they be clearly smaller than the distance between both cores 6. According to an essential characterizing feature of the invention, a permanent magnet 28 in the shape of a U is placed upon both polar mass systems 23 and 24 at the level of the slot 20 between the yokes so that the front faces of the magnet rest upon the polar masses.

As shown on the diagrammatic FIGS. 1 and 2 in the bistable relay arrangement according to the invention, both blades 9*a*, 9*b* are actuated by the energizing of the coils 7 so as to be caused to pivot alternately between and pulled towards their core or pushed away therefrom. To provide for this operation of both blades, the relay arrangement comprises a swinging device 30 which is but diagrammatically shown on the FIGS. 1 and 2 but comprises an element in the shape of a lever 31 with two arms with equal lengths, pivotally mounted onto a vertical axis 32, i.e. parallel to the flanges 5 of the yokes 3. The lever acts with its ends by means of connections 33 upon the blades 9*a*, 9*b* at the level of their upper end. Thus, a repelling motion of one blade 9*a*, 9*b* results in a attracting motion of the other one. Thus the swinging device constitutes a safety mechanism.

Figure 8:
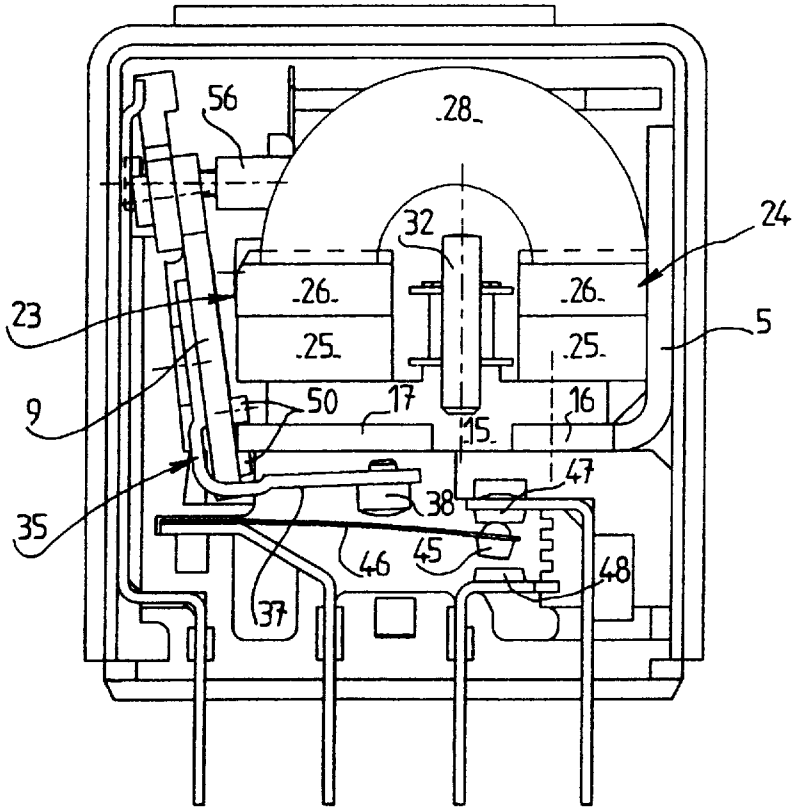
FIG. 8 is a view in section taken upon the line VIII—VIII of FIG. 5.
Figure 7:
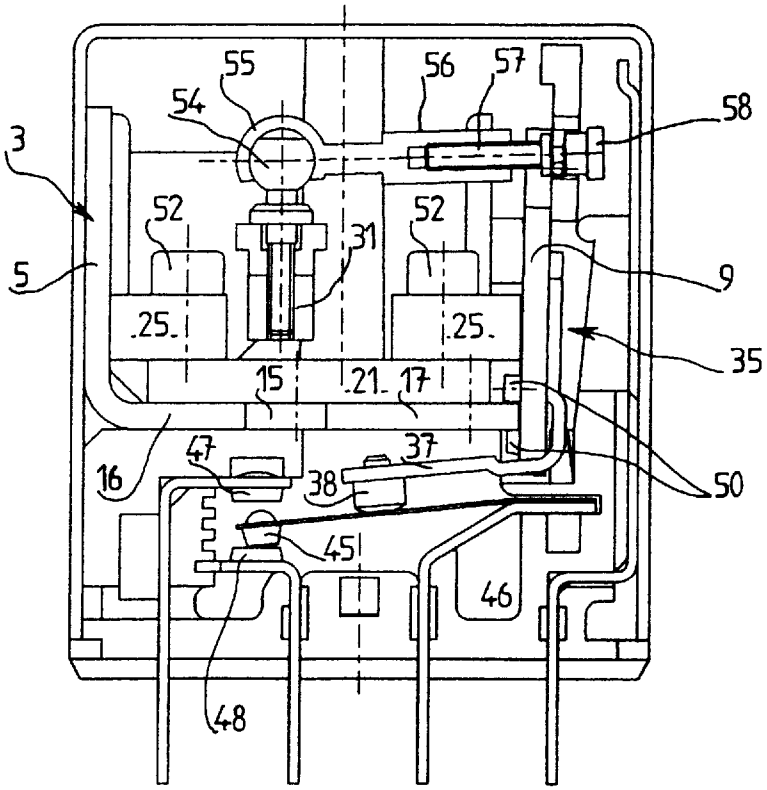
FIG. 7 is a view in section taken along the line VII—VII of FIG. 5.
Figure 5:
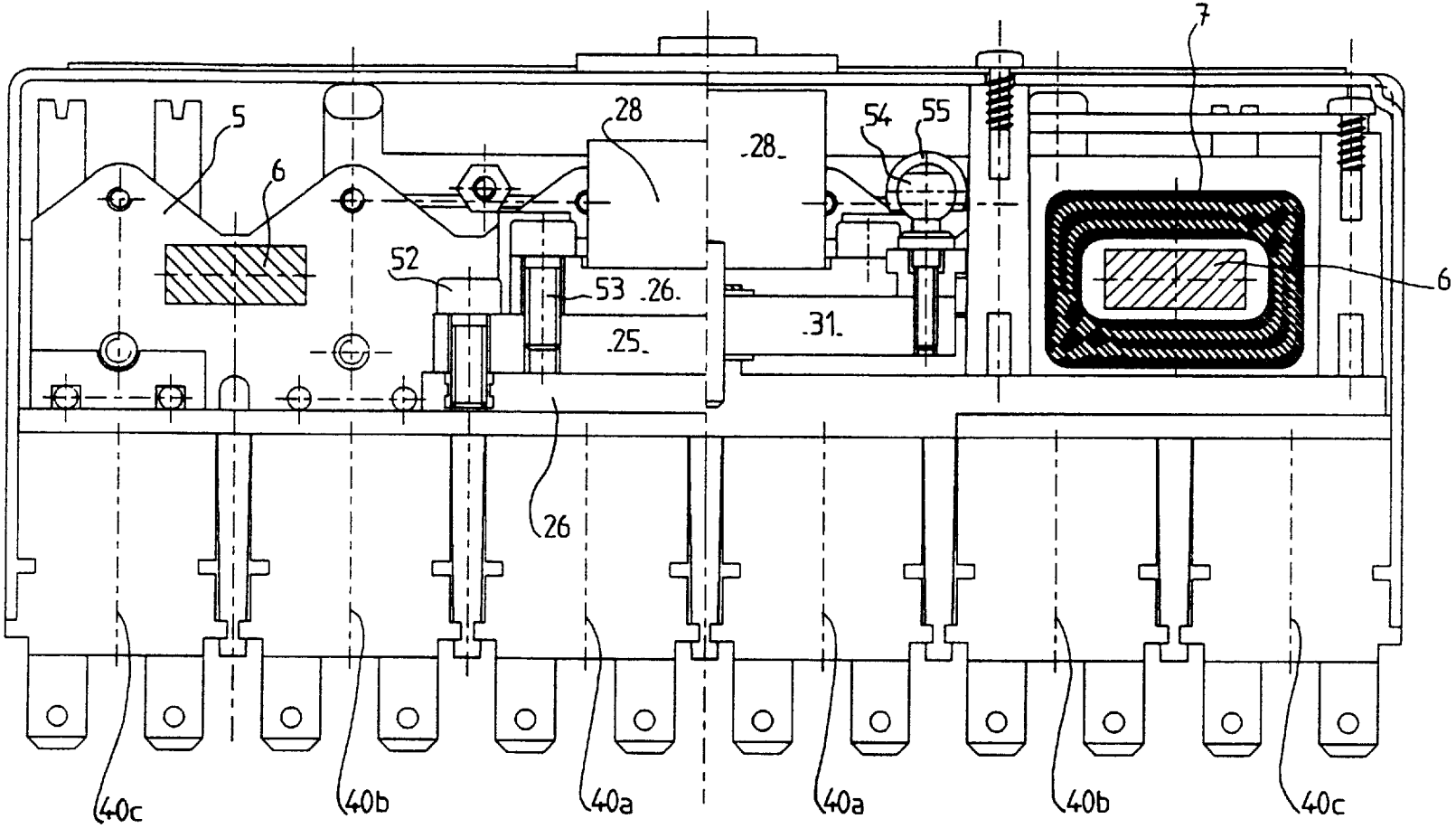

On FIGS. 1 and 2 is further shown that each blade 9*a*, 9*b* is adapted to carry three bent forks 35 one of which only is shown. Each fork 35 is fastened to the blade 9*a* or 9*b* by a screw 36 and carries at the ends of each fork leg 37 a stud 38 for actuating a relay contacts device 40 as seen on FIGS. 7 and 8. To allow the adjustment in the vertical direction of the forks 35 onto the blades 9*a*, 9*b* the passageway holes through the forks for the fastening screws 36 exhibit oblong shapes (not shown). It is further to be pointed out that the blades 9*a*, 9*b* carry on their zones caused to contact the edge face of the bars 17 of the yoke flange 12 and of the system of front polar mass 24 designated by 41 and 42, respectively, a plastic film made from kapton 43 which provides an artificial air gap for avoiding stickings which could be caused by irregularities of the blade surfaces.

For the continuation of the description, one should refer in particular to FIGS. 5 to 10 which show a practical exemplary embodiment of a bistable electromagnetic relay arrangement according to the present invention and the principle of structure of which has just been described with reference to FIGS. 1 and 2.

Figure 10:
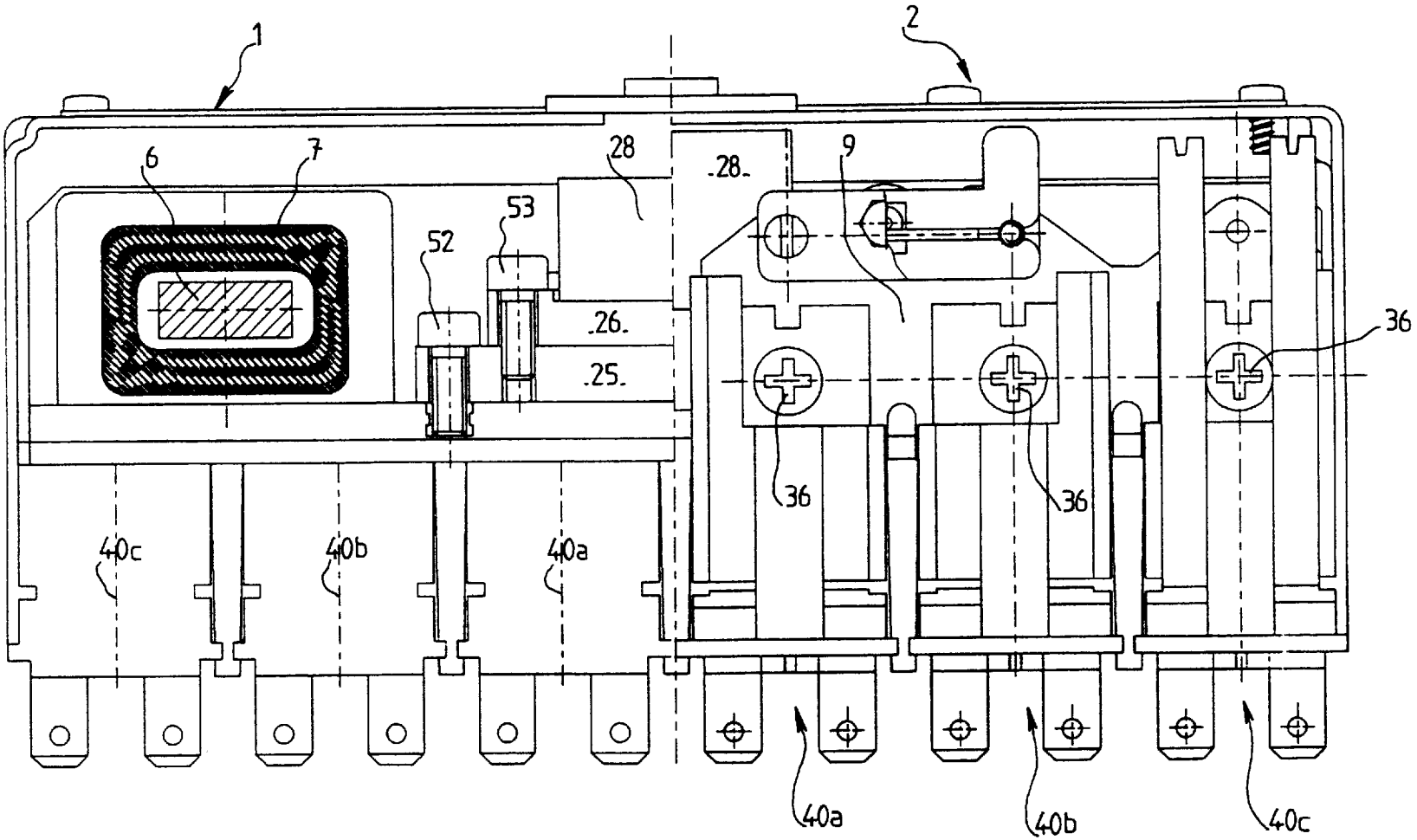
FIG. 10 is a view in section taken upon the line X—X of FIG. 5.

As clearly shown on FIGS. 9 and 10, each elementary relay device 1, 2 comprises three modules of contacts 40*a, b, c* which are likely to be removably rigidly connected to the yoke underneath the latter. Both modules 40*a* and 40*b* comprise each one two units of contacts, each one forming a reversing switch and comprising a movable contact 45 mounted at the free end of a flexible strip 46 the other end of which is fixedly mounted in the module and two stationary contacts, namely a rest contact 47 and a working contact 48. Each module 40*a*, 40*b* is associated with one fork 35 so that each strip 46 be actuated by one operating stud 38 of the fork. In the relay arrangement shown, both modules 40*c* form part of the device for energizing the coils 7 and their two units of contacts comprise one single movable contact 45 only co-operating with a stationary rest contact 47.

As to the device for the pivotal connection of the blades onto the yoke, it is seen that each blade comprises at its ends upper and lower bosses 50 for example provided by deep-drawing and between which is inserted the edge of the yoke bar 17.

Figure 5:
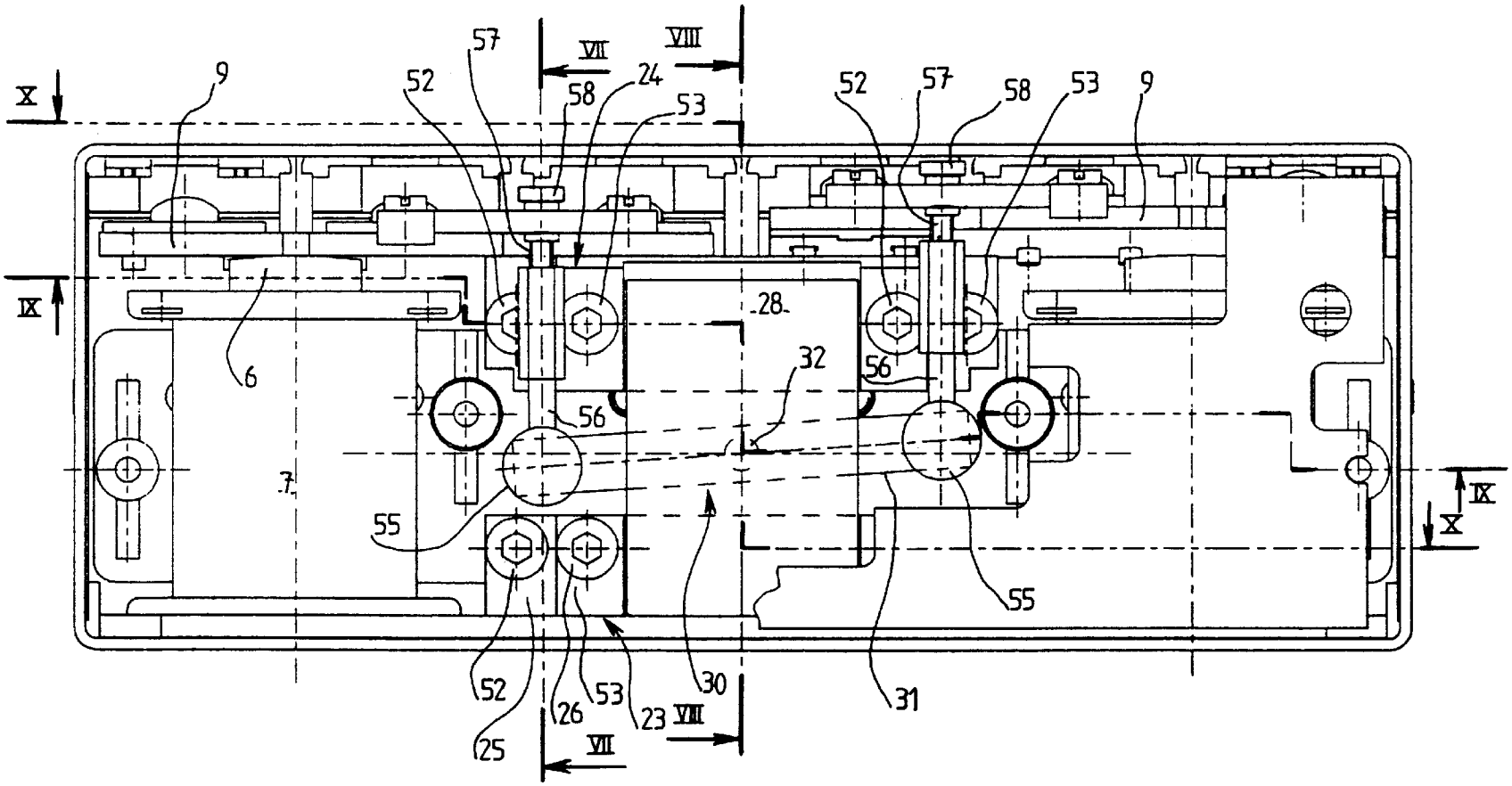
FIG. 5 is a top view of a bistable relay arrangement according to the present invention.
Figure 6:
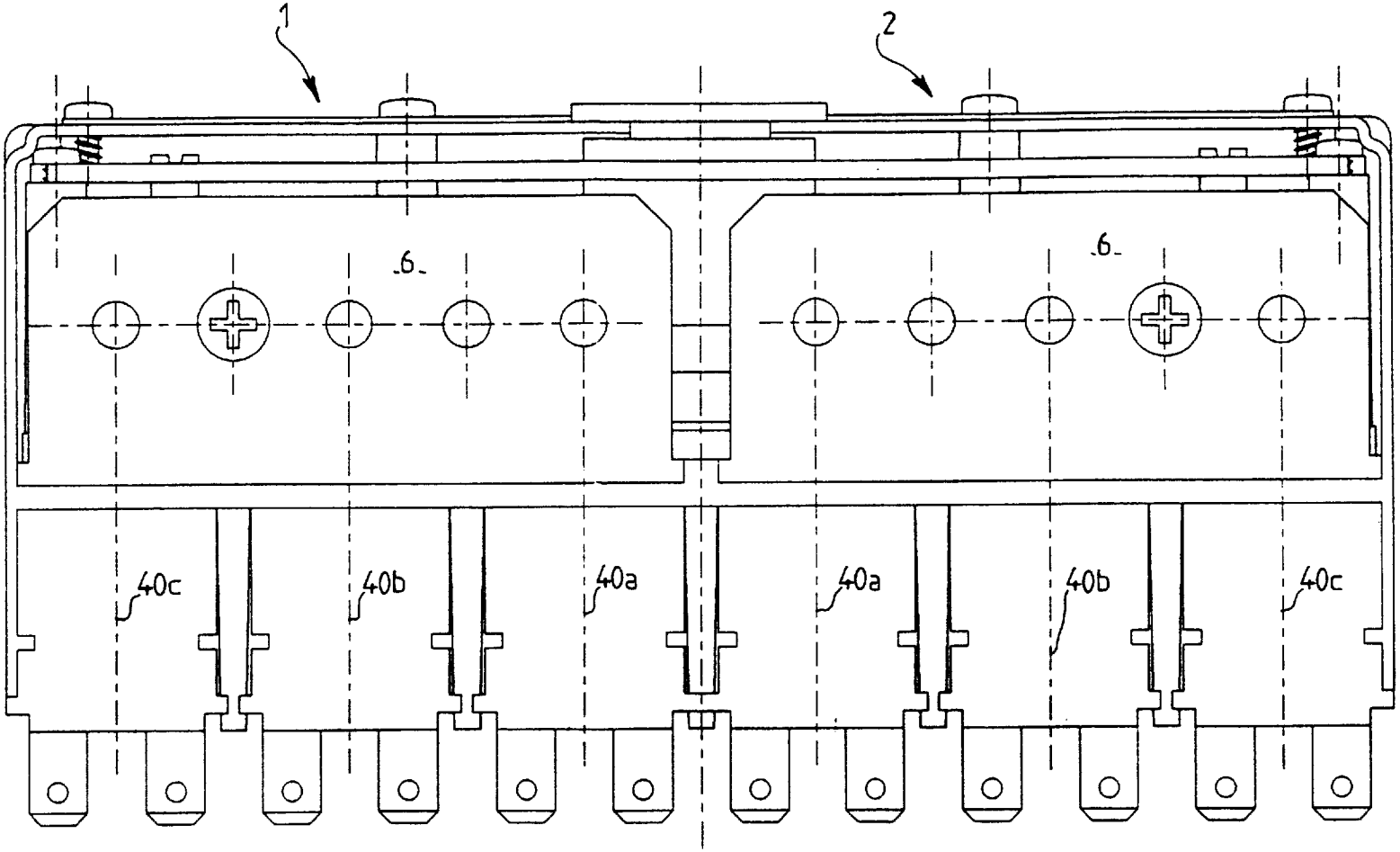
FIG. 6 is a view upon the rear of the arrangement of FIG. 5.

Moreover it is clearly shown on FIG. 5 that the lower bars 25 of each system of polar masses 23, 24 project with their two ends beyond the ends of the upper bars 26. Owing to this configuration, both bars of each system may be selectively fastened onto their supports by means of screws 52 and 53, respectively.

As to the swinging device 30, it is proved advantageous to provide at each end of the pivoting lever 31 a male element in the shape of a spherical head 54 onto which is caused to fit a female portion 55 of complementary shape mounted at the end of a pin 56 having a variable length and fastened at the upper portion of the blade 9*a*, 9*b*. The variation of the length of the pin 56 is obtained by means of a headed screw 57 which is adapted to be screwed more or less deep axially into the end of the pin.

The screw extends through the blade 9 and its head 58 is thus easily accessible from the outside face of the blade.

Referring again to FIGS. 1 and 2, the operation of the bistable relay arrangement according to the present invention will be described hereinafter. FIG. 1 shows the relay arrangement in the state of rest. Its coils 7 are not energized, i.e. not fed and one of the blades 9 denoted with a sticks onto the polar face of the core 6 of its actuating coil 7 whereas the other blade 9*b* is in the repelled state. The arrowed broken lines in dashes show the magnetic flux produced by the permanent magnet 28. The letters S and N designate the North and South poles, respectively. The flux F produced by the magnet 28 is divided into two partial fluxes Fa and Fb flowing through the blades 9*a* and 9*b*, respectively. The flux Fa passes from the north pole N of the magnet 28 through the left portion of the system of front polar mass 24, the closed blade 9*a*, the core 6, the flange 5 of the yoke 3 of the elementary relay 1 and the left portion of the system of back polar mass 23 for reaching the south pole S of the magnet 28. The flux Fb passes from the north pole N through the right portion of the system of front polar pieces 24, more specifically the lower bar 25, the gap formed between the latter and the repelled blade 9*b*, from the latter to the bar 17 at the level of the magnetic hinge 10 In the bar 17 towards the stuck blade 9*a* at the level of this latter from the bar 17 in the zone of the magnetic hinge through the core 6 and the upper bar 26 with the polar mass 23 to reach the south pole of the magnet. This magnetic flux Fb is of course much weaker than the flux Fa since it has to flow through the gap provided by the repelled blade 9*b*.

FIG. 2 shows the bistable relay arrangement at the time of the energizing of the coil 7 of the elementary relay 1, the other coil being not energized. The energized coil 7 generates a magnetic flux shown as a dotted arrowed line and designated with f. The energizing of the coil 7 produces a north pole N at the polar face of the core 6. Since the blade 9*a* also exhibits the magnetic polarity N, it is repelled under the effect of the repelling force thus generated as shown by the arrow R. Simultaneously with the repelling motion of the blade 9*a* is produced a movement pulling the blade 9*b* towards the polar face of the core 6 of the other elementary relay 2 shown by the arrow A under the effect of the electromagnetic flux f which by passing through the magnetic bar 17 flows from the blade 9*a* to the blade 9*b* and from the latter and the corresponding core 6 to the pole S through the system of polar mass 23. As shown on FIG. 2, the effect of repulsion exerted upon the blade 9*a* is further reinforced or strengthened by the fact that the electromagnetic flux f also passes through that portion of the blade and the forks which are projecting below the bar 17 thereby generating an attractive acting on the same direction of pivoting as the repelling force R.

It results from the foregoing that the rocking of both blades provided by the repulsion of the blade 9*a* is reinforced and accelerates owing to the repulsion of one blade and the attraction of the other blade. The lines of magnetic flux Fa, Fb and f show that the blades 9*a*, 9*b* and the bar 17 are attracted towards each other in the zone of their linear contact so that these contact zones actually form magnetic hinges.

The structure of the bistable relay arrangement according to the present invention which has just been described with reference to the figures allows in spite of its compactness a quick assembly while providing for a simple and easy adjustment of the contacts and component parts as will be shown hereinafter.

After the assembly of the whole system formed of the yokes 3, the coils 7, the blades 9*a*, 9*b* and the non magnetic support 21 which could be made as a separate part for example from brass and by overmolding over the yoke, one adjusts in a first step the working contacts 45–48 of the different modules 40*a* and 40*b*. For that purpose one inserts at first at each end a small rod or strip 18 into the gap 15 of the flange 12 of the yoke. Thus as shown on FIG. 3, one obtains a conventional monostable relay structure in which the electromagnetic flux closes through the L-shaped yoke, the blade and the core. By energizing each coil selectively, one obtains the closing of the blades. In this state of each blade, one causes the forks 35 to be lowered, the screws 36 being loosened until all the movable contacts 45 at the end of the flexible strips 46 or engaging the working contacts 48 under the effect of the studs 38 at the end of the forks 35. Each making of a contact could be shown for example by the lighting of a signal light (not shown). By continuing this sliding movement further over a predetermined distance, one imposes upon the contacts a desired accompanying, i.e. a certain contact pressure.

After the adjustment of the working contacts with a suitable accompanying, one proceeds with the mounting of the magnetic circuit at first by positioning the front and rear lower polar mass bars 25 onto the magnetic support 21 under the influence of the electromagnetic flux of the coils 7. The positioning of the magnetic bars is optimized by applying them on the one hand against the yokes 3 and on the other hand the closed blades 9*a*, 9*b*. FIG. 4 illustrates this operating step. After this optimization of the positioning, one fastens the bars in these positions by means of the screws 52. Then one preassembles the upper polar mass bars 26 and the permanent magnet 28 separately and one magnetizes this system. After the positioning of the magnetic short-circuit elements between both bars 26, one lays the system upon the lower bars 25 and one removes the magnetic short-circuit elements. The position of the bars is optimized by pushing them against the yokes and the blades. The bars 26 are then fastened in this position by tightening the screws 53.

In the following operating step one positions the swinging safety member 30 and one then adjusts, with a suitable accompanying, the rest contacts of the contact modules 40.

For that purpose in a first step one causes the closing of a blade and the repulsion of the other one. One then proceeds with the adjustment of the rest contacts 45–47 of the repelled blade by loosening the headed screws 57 through rotation of its head 58 until the system of the rest contacts be closed, this closing being checkable by the lighting of signal lamps. Then one causes the blades to tilt with a view to adjusting the rest contacts of the units of contacts associated with the blade now repelled. If the rest contacts are all closed and therefore all the signal lamps lit, one unscrews the screw 57 further by a suitable angle to provide the desired accompanying. If the rest contacts are not all made, one causes the screw 57 to turn until all the lamps be lit and one provides the desired accompanying by further turning the screw over a suitable angle. One readily understands that the adjustment of the contacts with the suitable accompanying consists in increasing the angle of pivoting of the blades and therefore in reducing the bearing force exerted by the forks of the blades upon the flexible strips 46 carrying the movable contact elements 45, through the medium of the operating studs 38.

What is claimed is:

1. A polarized bistable electromagnetic relay comprising:

a first monostable electromagnetic relay device comprising:

a first relay coil core having a first coil wound there around to generate an electromagnetic flux when electricity is applied to the first coil; and a first armature arranged to be coupled magnetically with the first relay coil core;

a second monostable electromagnetic relay device comprising:

a second relay coil core having a second coil wound there around to generate an electromagnetic flux when electricity is applied to the second coil; and a second armature arranged to be coupled magnetically with the second relay coil core; and a permanent magnet arranged to be coupled magnetically with the first and second armatures and the first and second relay coil cores, wherein a magnetic flux from the permanent magnet flows among the first and second relay devices, wherein the electromagnetic flux from the first relay coil core is superposed to the magnetic flux when electricity is applied to the first coil, thereby repulsing the first armature from the first relay core and, simultaneously, attracting the second armature to the second relay coil core.

2. The relay of claim 1, wherein the first relay device further comprises:

a first yoke having a first flange and a second flange, the first and second flanges arranged to form an L shape, and the first flange carrying the first relay coil core, wherein the first armature is pivotally mounted on the second flange of the first yoke; and the second relay device further comprises:

a second yoke having a first flange and a second flange, the first and second flanges arranged to form an L shape, and the first flange carrying the second relay coil core, the second armature is pivotally mounted on the second flange of the second yoke.

3. The relay of claim 2, which further comprises:

a first polar mass arranged to connect magnetically a first magnetic pole of the permanent magnet to the first and second yokes; and a second polar mass arranged to connect magnetically a second magnetic pole of the permanent magnet to the first and second armatures.

4. The relay of claim 1, wherein the first and the second yokes are spaced apart from and axially aligned with each other, and the relay further comprises:

a bar made of magnetic material disposed next to the second flanges of the first and second yokes for mounting the first and second armatures.

5. A polarized bistable electromagnetic relay comprising:

a first of monostable electromagnetic relay device comprising:

a first relay coil core having a first coil wound there around to generate an electromagnetic flux when electricity is applied to the first coil, the first relay coil core having a first end and a second end;

a first yoke having a first flange and a second flange, the first and second flanges arranged to form an L shape, and the first flange carrying the first relay coil core at the second end of the first relay coil core; and a first armature pivotally mounted on the first yoke, the first armature having an upper portion and a lower portion, and the upper portion magnetically coupled to the first end of the first relay coil core;

a second of monostable electromagnetic relay device comprising:

a second relay coil core having a second coil wound there around to generate an electromagnetic flux when electricity is applied to the second coil, the second relay coil core having a first end and a second end;

a second first yoke having a first flange and a second flange, the first and second flanges arranged to form an L shape, and the first flange carrying the second relay coil core at the second end of the second relay coil core;

a second armature pivotally mounted on the second yoke, the second armature having an upper portion and a lower portion, and the upper portion magnetically coupled to the first end of the second relay coil core;

a permanent magnet having a first magnetic pole and a second magnetic pole;

a first polar mass arranged to connect magnetically the first magnetic pole of the permanent magnet to the yokes first and second; and a second polar mass arranged to connect magnetically the second magnetic pole of the permanent magnet to the first and second armatures, wherein a magnetic flux from the permanent magnet flows among the first and second armatures, the first and second relay coil cores and the first and second yokes, wherein the electromagnetic flux from the first relay coil core is superposed to the magnetic flux when electricity is applied to the first coil, thereby repulsing the first the upper portion of the armature from the first end of the first relay core and, simultaneously, attracting the upper portion of the second armature to the first end of the second relay coil core.

6. The relay of claim 5, wherein the first and second armatures are magnetically mounted to the first and the second yokes, respectively.

7. The relay of claim 5, which further comprises a non magnetic support laid upon the second flanges of the yokes, and the first and second polar masses disposed over the non magnetic support.

8. The relay of claim 7, which further comprises a safety device including a lever with two arms, the lever pivotally mounted on the non magnetic member, each of the arms coupled to a corresponding upper portion of the first and second armatures, thereby a repulsing movement of one upper portion results in an attracting movement of the other upper portion.

9. The relay of claim 8, lever further comprising;

a connecting pin for each of the arms for connecting the arms to the corresponding upper portions; and a head provided to each of the pins to connect the arms to the lever.

10. The relay of claim 9, wherein the length of the connecting pin is adjustable by means of a screw provided coaxially thereon.

11. The relay of claim 5, which further comprises an electric contact removably mounted to the relay devices and extending underneath the yokes.

12. The relay of claim 5, which further comprises a support mounted on each of the armatures and an electric contact mounted on each of the supports.

13. The relay of claim 12, wherein the support is adjustable mounted on the armature by means of an adjusting screw.

14. The relay of claim 13, wherein the repulsing of the upper portion of the first armature and the attracting of the upper portion of the second armature causes the electric contact to move from one position to another position.

15. The relay of claim 5, wherein the first and the second yokes are spaced apart from and axially aligned with each other, and the first and second yokes including a bar disposed apart from the second flanges to form a gap there between, the bar extending between the first and the second yokes and made of magnetic material on which the first and second armatures are mounted.

16. The relay of claim 15, which further comprises a rod adapted to be inserted into the gap between the magnetic bar and the second flanges of the yokes so that when the bar is inserted into the gap, the magnetic flux generated by one of the relay coil cores passes through the relay coil cores and armatures the bar, the rod and the yokes.

17. The relay of claim 16, which further comprises:

a support adjustable mounted on each of the armatures; and an electrical contact mounted on each of the supports and disposed underneath the relay.

18. The relay of claim 16, wherein each of the polar masses comprise a lower bar and an upper bar and the lower bars are adapted to be positioned to abut against the yokes and the armatures after the rod has been positioned in the yokes and when electricity is applied to the first and second coils.

19. The relay of claim 18, wherein the upper polar mass bars and the permanent magnet are preassembled, magnetized and positioned onto the lower bars and the upper bars may be selectively positioned by pushing them against the yokes and the closed armatures when the rod is not inserted into the gap.

20. The relay of claim 19, which further comprises additional supports adjustable mounted on the armatures and additional electrical contacts mounted on corresponding supports.

* * * * *

UNITED STATES PATENT AND TRADEMARK OFFICE
CERTIFICATE OF CORRECTION

PATENT NO. : 5,867,081

DATED : February 2, 1999

INVENTORS : Daniel ARNOUX et al.

It is certified that error appears in the above-identified patent and that said Letters Patent is hereby corrected as shown below:

Column 8, line 31 (claim 9, line 1): after "The relay of claim 8," insert --the--.

Column 8, line 47 (claim 13, line 2): change "able" to --ably--.

Column 10, line 8 (claim 20, line 2): change "adjustable" to --adjustably--.

Signed and Sealed this

Sixth Day of July, 1999

*Attest:*

Q. TODD DICKINSON

*Attesting Officer*

*Acting Commissioner of Patents and Trademarks*